United States Patent [19]

Alf et al.

[11] Patent Number: 4,633,266

[45] Date of Patent: Dec. 30, 1986

[54] ELECTRICALLY PROJECTABLE TELESCOPIC ROD ANTENNA, PARTICULARLY FOR AUTOMOTIVE INSTALLATION

[75] Inventors: Reinhard Alf; Kurt Klinkwitz, both of Berlin, Fed. Rep. of Germany

[73] Assignee: Robert Bosch GmbH, Stuttgart, Fed. Rep. of Germany

[21] Appl. No.: 644,377

[22] Filed: Aug. 27, 1984

[30] Foreign Application Priority Data

Oct. 22, 1983 [DE] Fed. Rep. of Germany ..... 3338511

[51] Int. Cl.[4] ..... H01Q 1/10; H01Q 1/32

[52] U.S. Cl. ..... 343/903

[58] Field of Search ..... 343/877, 903, 900

[56] References Cited

U.S. PATENT DOCUMENTS 2,581,171 1/1952 Carlson ..... 343/903

4,300,141 11/1981 Carolus et al. ..... 343/903

OTHER PUBLICATIONS

Automatic-Antennen Auta 6000 EL . . . Hirschmann, p. 15.

*Primary Examiner*—Eli Lieberman

*Attorney, Agent, or Firm*—Frishauf, Holtz, Goodman & Woodward

[57] ABSTRACT

To simplify the construction of a telescopic antenna which is projected and retracted, respectively, by a flexible wire, a rotatable wind-up drum (10) is formed with an inner space (17) to provide for wind-up of the flexible wire, the inner space, likewise, retaining a gear ring (20) in which gear projections (41) of the wire are engaged. The wire, preferably, is an elastic plastic wire element, coupled to the projecting telescoping element (A2) of a telescoping antenna (A), the drum (10) being driven by a motor (35) which receives rotation coupled thereto by a worm drive (29–34).

20 Claims, 6 Drawing Figures

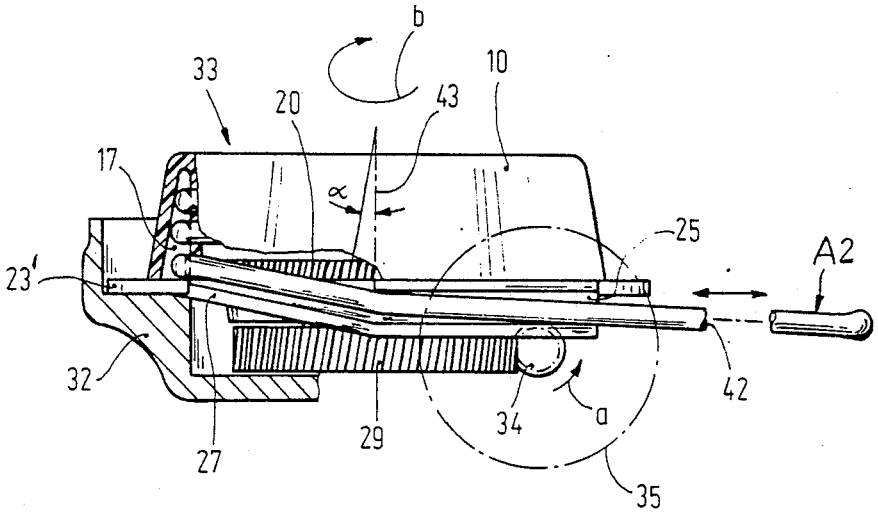
Fig. 2
Fig. 3
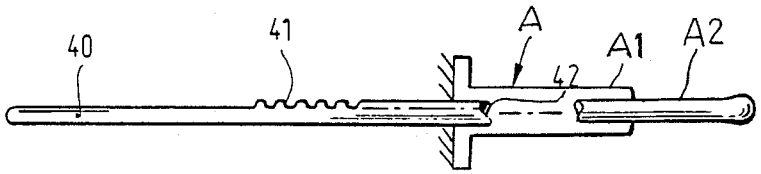

ELECTRICALLY PROJECTABLE TELESCOPIC ROD ANTENNA, PARTICULARLY FOR AUTOMOTIVE INSTALLATION

The present invention relates to telescopic-type rod antennas, and more particularly to retractable automobile rod antennas, in which an electric motor is provided to selectively, controllably project or retract a rod-like antenna element from, or within, a telescopic antenna element.

BACKGROUND

Telescopic antennas are frequently used in automotive installations, and some of them utilize an electric motor to project an inner antenna rod from an outer telescopic antenna sleeve or tube. The outer telescopic antenna sleeve or tube may be recessed within the automotive vehicle or, itself, project from a portion of the vehicle, for example a fender. To project the telescopic antenna rod, it has been proposed to couple a toothed or geared flexible supply wire through the outer tubular element, and couple the teeth or gear elements on a flexible wire with a gear wheel, driven by the electric motor; upon rotation of the gear wheel, the flexible wire, which is threaded through the outer tubular element of the telescopic antenna, will then, selectively, project or retract the inner telescopic element. In the system described—known as the Hirschmann automatic antenna AUTA 6000 EL—a belt drive couples an electric motor with the gear which is in engagement with the toothed or geared portion of the flexible wire. The flexible wire is wound up in a wind-up space of a stationary wind-up drum when the antenna is intended to be retracted.

THE INVENTION

It is an object to simplify a telescopic antenna drive utilizing a geared, flexible wire, and more particularly to provide a unitary compact assembly in which the power requirements to the motor are reduced and the entire structure can be made as a single compact unit which is easily installed and serviced.

Briefly, the wind-up drum is coupled to be driven by the motor and formed with a gear ring which is located in the wind-up space of the wire on the drum, the gearing on the wire being in engagement with the gear ring on the wind-up drum. The wind-up drum, itself, is driven by the electric motor, example by a gear ring coupled to the wind-up drum and the motor, respectively. This connecting drive, preferably, includes a worm gear since, usually, the speed of the motor is substantially higher than the rotary speed of the wind-up drum.

The system has the advantage that the wind-up drum and the gearing to, selectively, project and retract, in short, to move the coupling wire, forms a single unit, so that the power transmission elements are substantially simplified. The gear teeth on the gear ring of the wind-up drum preferably are spiralled or inclined with respect to the axis of rotation of the wind-up drum, which substantially simplifies assembly of the wire to the wind-up drum. The wire itself is, preferably, a flexible plastic element on which gear teeth are formed, for example in form of a rack, or in which the circumference of the wire is, otherwise, toothed or geared or ridged for engagement with the gearing of the wind-up drum. All elements, other than the electric motor, of course, can be made of plastic, easily assembled, or as, at least in part, unitary injection-molded plastic parts.

DRAWINGS

FIG. 2 is a side view, partly in section, of the elements of FIG. 1, when assembled;

FIG. 3 is a side view of the flexible connecting wire, in which the coupling to the antenna is shown only schematically.

DETAILED DESCRIPTION

The wind-up unit, basically, has four parts: A wind-up drum 10; a coupling element 11; a wire guide element 12; and a gear element 13.

Figure 1:
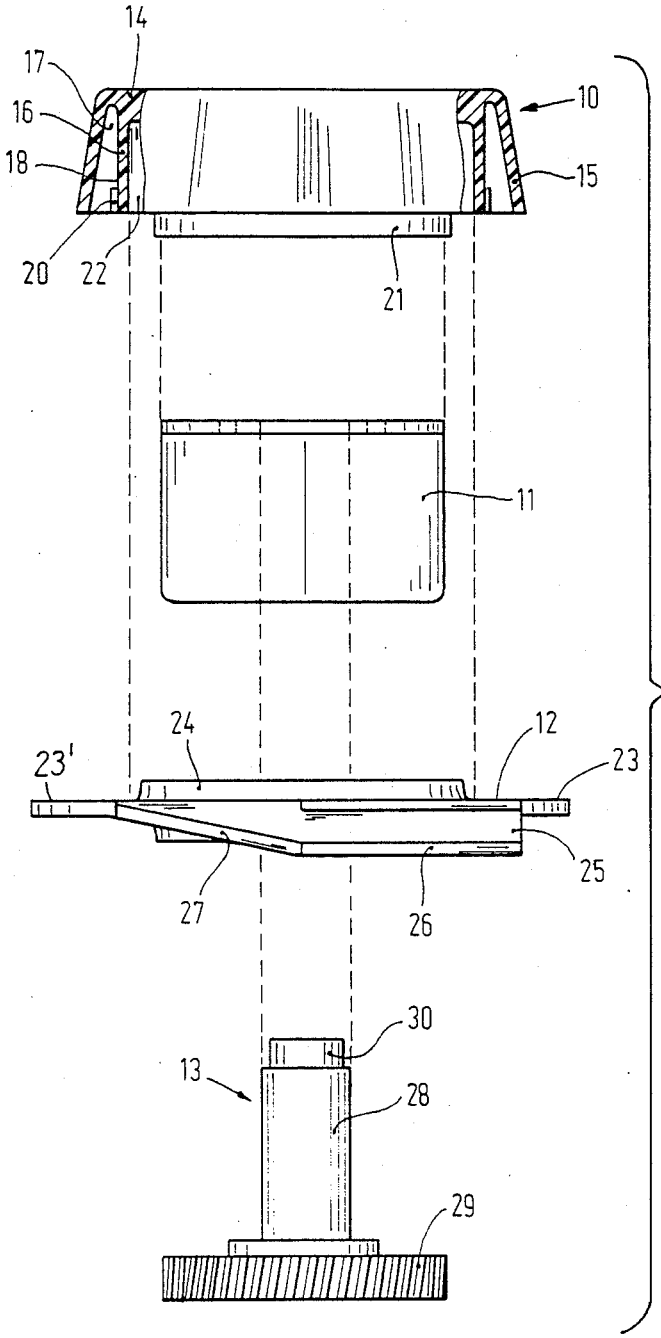
FIG. 1 is an exploded schematic view, partly in section, of the wind-up structure for a flexible antenna wire, including a wind-up drum, a coupling element, a wire guide element, and a rotation transmitting element.

The wind-up drum 10 is a pot or cup-shaped unit which has an inner wall 16 and an outer wall 15, the outer wall 15 projecting in a slanting or conical direction from the essentially cylindrical inner wall 16, to define between the inner and outer wall a wind-up space 17, which tapers upwardly—with respect to FIG. 1—to a narrowed portion. The upper region of the wind-up drum 10 is formed by a flat cover 14, to prevent contamination or dirt from entering the interior of the drum, but may be left open. The relationship of the diameters between the outer wall 15 and the inner wall 16 is so selected that the space 17 remaining therebetween is sufficient to wind up a flexible antenna moving wire 42 (FIG. 3) when the antenna A (FIG. 3) is retracted.

In accordance with a feature of the invention, the wind-up drum 10 is formed with a gear ring 20, located on the outer side 18 of the inner wall 16 in the region remote from the plate 14. The open end of the wind-up drum 10 is formed with a tubular extension 21.

The wind-up drum 10 is guided for rotation by a coupling element 11 which fits into the hollow interior 22 of the wind-up drum 10; the coupling element 11 is secured to the wind-up drum 10 to rotate therewith, for example by being adhesively connected to the bottom 14, or otherwise joined to the wind-up drum 10 to transmit rotation thereto.

A wire guide element 12, formed with an opening and rotatably fitting about the coupling element 11, is formed as an essentially flat ring 23 having a cylindrical extension 24 at the upper side thereof, loosely and rotatably fitting about the coupling element 11 and within the inner wall of the wind-up drum 10. The wind-up drum 10, upon rotation, thus is guided about the projection 24 by engagement of the inner wall 16 against the outer circumference of projection 24 and of the coupling element 11 within a central opening in the wire guide element 23. The lower side of the flat ring 23 is formed with an elongated entry opening of approximately U-shaped cross section, in which the legs U are outwardly directed. The lower leg 26 of the U-shaped entry opening is extended to an upwardly directed deflection wall 27, merging with the ring 23.

The gear or drive element 13 is formed by a cylindrical stub or pin 28 to which helical gear 29 is secured. The pin 28 is formed, at its upper end, with a cylindrical section 30 of reduced diameter.

The elements 10, 11, 12 and 13 may be unitary parts, preferably plastic injection-molded elements, although the drum 10, for example, may be made of composite, assembled cylindrical elements, and the gear element 13 may be assembled of separate gear-and-pin or shaft parts. When assembled—see FIG. 2—the elements 10, 11, 12 and 13 are so connected that the gear element 13 is coupled to the coupling element 11 to transmit rotation thereto, and is axially irremovably retained in the wall portion 14 of the wind-up drum. FIG. 2 also illustrates an outer housing 32 for the telescopic antenna which retains the respective elements 10–13 shown in FIG. 1 in the interior thereof. The ring 23 of the wire guide element 12 is secured within the housing 32 to be non-rotatable with respect thereto, for example by a projecting lip or tab 23' (FIG. 1) engaged by a pin in the housing 32, or otherwise secured therein, for example by adhesion or an interengaging projection-and-recess fit. The wind-up drum 10, however, is rotatably retained within the housing 32. An electric motor 35, shown only schematically, is coupled by a worm 34 to the gear 29.

Figure 4:
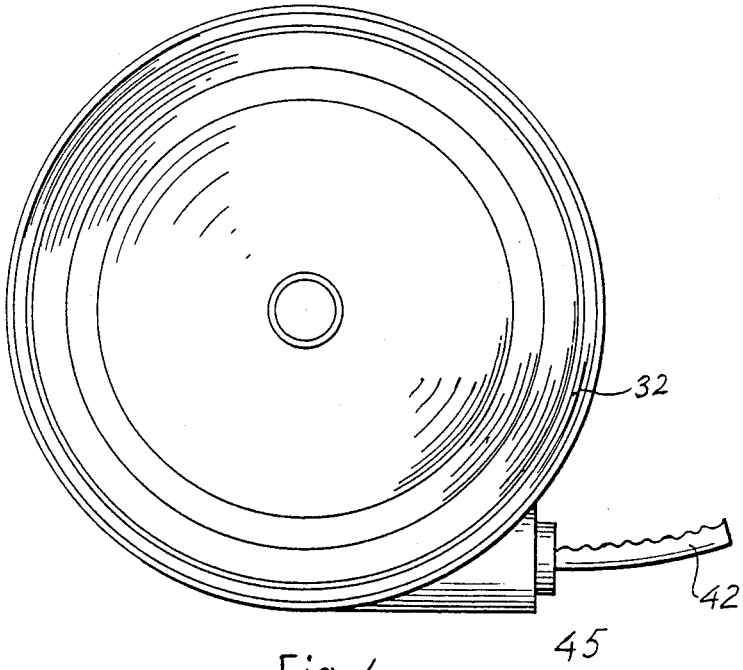
FIG. 4 is a top view of the wind-up drum and outer housing of FIG. 2.

FIG. 4 shows the housing 32, with its tubular extension 45 for guiding the wire 42 into the housing.

Figure 5:
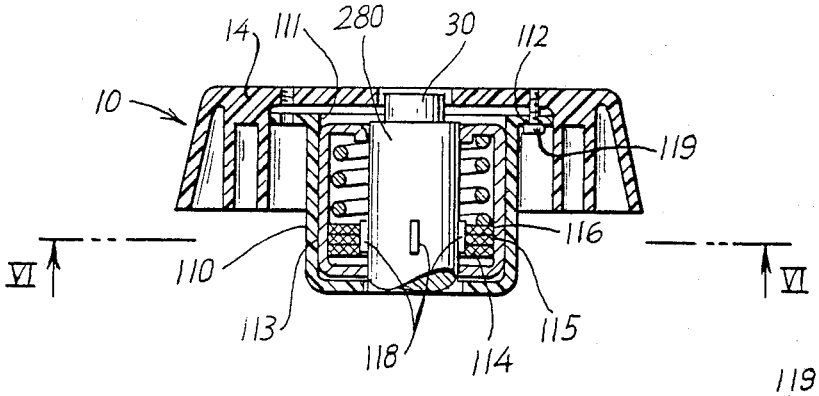
FIG. 5 is a cross-sectional view through the wind-up drum and coupling element, rotated 90° on a vertical axis from the viewpoint of FIG. 1.

FIG. 5 illustrates a conventional slip clutch, in which the coupling element 11, 110 has an opening 111 for receiving a U-shaped casing 112. Three annular coupling discs 114, 115, 116 are disposed inside the closed end of the U-shaped casing 112 and are pressed together by a spring 113 which also bears against the upper inside lip of the casing 112.

Figure 6:
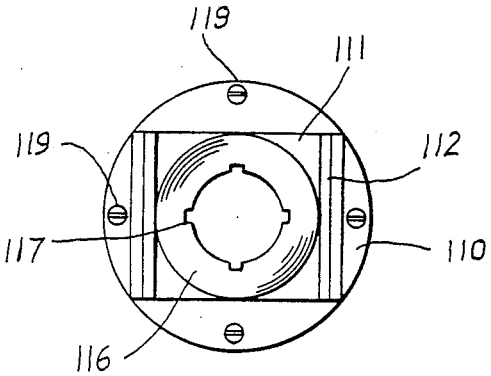
FIG. 6 is a cross-sectional view along line VI—VI of FIG. 5.

As shown in FIG. 6, the coupling discs 114, 115, 116 each have radial inner notches 117 which engage longitudinal cam ridges 118 formed on the surface of pin 28, 280. A plurality of screws 119 secure the coupling element 11, 110 to wall portion 14 of the drum.

Operation: The wind-up drum 10 is rotated by the worm gear 29 and the worm 34, secured to the shaft of the motor 35, so that, upon rotation of the motor, and hence of the worm 34 in the direction of the arrow a (FIG. 2), the gear 29 and the wind-up drum 10, coupled thereto, will rotate in the direction of the arrow b. The free end 40 of the antenna coupling wire 42 is guided through the entrance opening 25, deflected by the deflection surface 27, and then its gear portion 41 is engaged by the gear teeth of the gear ring 20 on the inner wall of the wind-up drum 10. Preferably, the gear teeth 20 are inclined by an angle $\alpha$ with respect to the axis of rotation 43 of the wind-up drum. As the drum rotates, the wire 42 will wind in superimposed winding loops within the space 17 until the inner telescopic element A2 of an antenna A (FIG. 3) is retracted to the desired distance within an outer telescopic element A1, secured, for example, to the housing 32 or to a structural component of an automotive vehicle, to which, also, the housing 32 and the motor 35 can be attached by any suitable and well known means. The connection of the wire 42 to the inner telescopic element A2 is shown only schematically in FIG. 3. Upon reversal of the direction of rotation of the motor 35, the gear ring 41, by engagement with the inner gearing 20 of the wind-up drum, push against the inner telescopic element A2 of the antenna A to push out the telescopic element A2 from the outer telescopic element A1.

If the rotation of the wind-up drum with pin 28 is blocked or strongly braked, the resulting tighter winding of spring 113 pushes the discs 114, 115, 116 off the ridges 118, thereby allowing the clutch to slip and preventing damage to the drive mechanism.

Preferably, the wire 42 is an elongated elastic, flexible, plastic wire having projections 41 formed thereon. The projections 41 may, for example, be in form of a rack, or ring-shaped projections circumferentially extending about the elongated flexible element 42, forming, for example, a plastic wire. Surface 27 preferably is inclined with respect to a plane perpendicular to axis 43 (FIG. 2) by the same angle $\alpha$, so that teeth 41 on the wire 42 and the gear teeth 20 on the wind-up drum 10 mesh easily.

Various changes and modifications may be made, and features described herein may be used with any of the others, within the scope of the inventive concept.

We claim:

1. A telescopic rod antenna, particularly for automotive installation, and unitary drive combination having a telescopic antenna unit (A; A1, A2);

an electric motor (35) to project, or retract, a first part (A2) telescopically within a second part (A1) of the antenna unit;

a flexible elongated element (42) located within said second part (A1) and coupled to the first part (A2) of the antenna, said elongated element and said antenna parts together constituting a readily replaceable unit;

a wind-up drum (10) to receive the flexible elongated element (42);

means (23) for guiding the flexible elongated element (42) to the wind-up drum (10), for winding thereon, upon retracting movement of the first antenna part (A2) within the second antenna part (A1), and comprising, in accordance with the invention, a drive coupling (13; 29, 34) rotatably coupling the drum (10) to the motor;

a slip clutch (111–119) acting between the wind-up drum and the output of the drive coupling (13; 29, 34);

a gear ring (20) located on the wind-up drum (10) and positioned in a space (17) thereon, within which the elongated element (42) winds on the drum; and gearing teeth (41) formed on the elongated element (42) and engaged by the gear ring (20) of the wind-up drum for, selectively, projection, from the wind-up space (17), of the elongated element (42) upon rotation of the wind-up drum in a given direction, and wind-up, within the wind-up space (17), of the elongated element (42), on the wind-up drum (10), upon rotation of the motor (35) in reverse direction, said rotation being coupled to the wind-up drum (10) by the drive coupling (13; 29, 34).

2. Antenna and drive combination according to claim 1, wherein the gear ring (20) has gear teeth which are inclined by an angle ($\alpha$) with respect to the axis of rotation (43) of the wind-up drum (10).

3. Antenna and drive combination according to claim 1, wherein the elongated element is a flexible wire.

4. Antenna and drive combination according to claim 1, wherein the elongated element is a flexible plastic wire having gear-like projections (41) formed thereon.

5. Antenna and drive combination according to claim 2, wherein the elongated element is a flexible plastic wire having gear-like projections (41) formed thereon.

6. Antenna and drive combination according to claim 1, wherein the wind-up drum (10) comprises two coaxial pot or cup-shaped elements, telescopically received within each other and defining, between the outer wall of an inner element (16) and the inner wall of an outer element (15) said wind-up space (17).

7. Antenna and drive combination according to claim 6, wherein the gear ring (20) is formed on the outer wall of the inner element (16) of the wind-up drum (10).

8. Antenna and drive combination according to claim 7, wherein the gear ring (20) has gear teeth which are inclined by an angle ($\alpha$) with respect to the axis of rotation (43) of the wind-up drum (10).

9. Antenna and drive combination according to claim 1, wherein the wind-up drum (10) and the gear ring (20) thereon form a unitary plastic injection molding.

10. Antenna and drive combination according to claim 9, wherein the gear ring (20) has gear teeth which are inclined by an angle ($\alpha$) with respect to the axis of rotation (43) of the wind-up drum (10).

11. Antenna and drive combination according to claim 9, wherein the elongated element is a flexible wire, and wherein the gear teeth on the flexible elastic wire match the gearing of the gear ring (20) on the wind-up drum (10).

12. Antenna and drive combination according to claim 1, wherein the wind-up drum, the elongated element guide means (23) and the drive coupling (13) form coaxial elements fitted within each other;

and a pot-shaped housing (32) coaxially surrounding said coaxial elements and retaining said elements in position for rotation of said wind-up drum (10) and said drive coupling about an axis of rotation (43), while non-rotatably retaining said elongated element guide means (23) within the housing.

13. Antenna and drive combination according to claim 12, wherein said elements are located within the housing in this order:

wind-up drum (10);

elongated element guide means (23);

drive coupling (13); to place the elongated element guide means (23), non-rotatably, within the housing between the rotatable wind-up drum (10) and the drive coupling (13);

and journal bearing means (11; 24; 28), including said slip clutch, journalling said drum and said drive coupling for rotation about said guide means (23).

14. Antenna and drive combination according to claim 1, wherein the drive coupling comprises a worm drive (29, 34) having a worm (34) coupled to the motor and a matching worm gear (29) engaged by the worm, the worm gear being coupled to said wind-up drum for transmission of rotation thereto.

15. Antenna and drive combination according to claim 13, wherein the drive coupling comprises a worm drive (29, 34) having a worm (34) coupled to the motor and a matching worm gear (29) engaged by the worm, the worm gear being coupled to said wind-up drum for transmission of rotation thereto.

16. Antenna and drive combination according to claim 1, wherein the elongated element guide means (23) includes a guide surface (27) guiding the elongated element (42) into the wind-up space (17) with the gearing teeth (41) on the elongated element (42) meshing with the gear teeth of said gear ring (20) on the wind-up drum.

17. Antenna and drive combination according to claim 16, wherein the gear ring (20) has gear teeth which are inclined by an angle ($\alpha$) with respect to the axis of rotation (43) of the wind-up drum (10);

and said guide surface is inclined with respect to a plane perpendicular to the axis of rotation (43) of the wind-up drum (10) by approximately said angle ($\alpha$).

18. Antenna and drive combination according to claim 17, wherein the elongated element is a flexible wire.

19. Antenna and drive combination according to claim 17, wherein the elongated element is a flexible plastic wire having gear-like projections (41) formed thereon.

20. Antenna and drive combination according to claim 17, wherein the wind-up drum, the elongated element guide means (23) and the drive coupling (13) form coaxial elements fitted within each other;

and a pot-shaped housing (32) coaxially surrounding said coaxial elements and retaining said elements in position for rotation of said wind-up drum (10) and of said drive coupling about an axis of rotation (43), while non-rotatably retaining said elongated element guide means (23) within the housing.

* * * * *